US005341741A

United States Patent [19]

Schneider et al.

[11] Patent Number: 5,341,741

[45] Date of Patent: Aug. 30, 1994

[54] DOCTOR BLADE BAR FOR A SHORT INKING SYSTEM

[75] Inventors: Georg Schneider, Würzburg; Wolfgang O. Reder, Veitshöchheim; Dieter Reinhart, Hettstadt, all of Fed. Rep. of Germany

[73] Assignee: Koenig & Bauer Aktiengesellschaft, Wurzburg, Fed. Rep. of Germany

[21] Appl. No.: 51,124

[22] Filed: Apr. 26, 1993

[30] Foreign Application Priority Data

Apr. 25, 1992 [DE] Fed. Rep. of Germany ..... 4213663

[51] Int. Cl.[5] ..... B41F 31/04; B41L 27/06

[52] U.S. Cl. ..... 101/365; 101/157; 101/167; 101/169

[58] Field of Search ..... 101/363–366, 101/157–169; 118/261

[56] References Cited

U.S. PATENT DOCUMENTS

| | | | |
|---|---|---|---|
| 2,359,770 | 10/1944 | Lundbye | 101/157 |
| 2,704,026 | 8/1953 | Rogge et al. | 101/157 |
| 3,877,369 | 4/1975 | D'Amato et al. | 101/157 |
| 4,050,380 | 9/1977 | Pfizenmaier | 101/365 |
| 4,314,506 | 2/1982 | Rees | 101/363 |
| 4,414,900 | 11/1983 | Kraus et al. | 101/363 |
| 4,938,133 | 7/1990 | Bock et al. | 101/349 |
| 5,031,532 | 7/1991 | Walther | 101/247 |
| 5,168,806 | 12/1992 | Reder et al. | 101/366 |

FOREIGN PATENT DOCUMENTS

| | | | |
|---|---|---|---|
| 0155524 | 2/1904 | Fed. Rep. of Germany | 101/365 |
| 233430 | 4/1910 | Fed. Rep. of Germany . | |
| 2264119 | 12/1972 | Fed. Rep. of Germany . | |
| 2538908 | 9/1975 | Fed. Rep. of Germany . | |
| 2539846 | 3/1977 | Fed. Rep. of Germany | 101/365 |
| 3838546 | 11/1988 | Fed. Rep. of Germany . | |
| 3841116 | 12/1988 | Fed. Rep. of Germany . | |
| 9107179 | 8/1991 | Fed. Rep. of Germany . | |
| 8300656 | 3/1983 | PCT Int'l Appl. . | |
| 1434068 | 4/1976 | United Kingdom | 101/365 |
| 2132139 | 7/1984 | United Kingdom | 101/365 |

*Primary Examiner*—Edgar S. Burr
*Assistant Examiner*—Lynn D. Hendrickson
*Attorney, Agent, or Firm*—Jones, Tullar & Cooper

[57] ABSTRACT

A doctor blade bar for a short inking unit employs an eccentric disk to engage an abutment on a doctor blade holder to retract a doctor blade that is held by the holder and a cooperating doctor blade guide into a retracted position with respect to a screen roller, Disengagement of the eccentric disk from the abutment allows the doctor blade to be moved by a pressure spring into contact with the screen roller.

8 Claims, 3 Drawing Sheets

DOCTOR BLADE BAR FOR A SHORT INKING SYSTEM

FIELD OF THE INVENTION

The present invention is directed generally to a doctor blade bar for a short inking unit. More particularly, the present invention is directed to a doctor blade bar for a short inking system of a web-fed rotary printing press. Most specifically, the present invention is directed to a doctor blade bar of a short inking system for a web fed rotary printing press which is disposed below a screen roller. The doctor blade bar can be placed against the screen roller generally in a vertical direction of movement and the doctor blade or blades which are carried by the doctor blade bar have a negative placement angle with respect to the screen roller.

DESCRIPTION OF THE PRIOR ART

Short inking units for use in web-fed rotary printing presses are generally known in the prior art. In these short inking units, it is conventional to utilize two spaced, axially extending doctor blades, in conjunction with spaced end plates, to form an ink receptacle or chamber. Ink is placed in this chamber and free ends of the doctor blades are brought into contact with the surface of an ink roller, which is frequently a screened surface ink roller. In such short inking units it is typically necessary to be able to bring the doctor blades into and out of contact with the surface of the screened ink roller and to be able to adjust the position of the doctor blades as well as to replace them when they become excessively worn.

In one prior art device, as shown in German published unexamined patent application No. 38 38 546 there is shown a chambered doctor blade assembly. In this device the doctor blades are insertable into slots and can be removed from these slots so that they can be quickly exchanged.

Another prior art assembly is shown in German published unexamined patent application No. 35 38 908. In this prior art device there is disclosed the resilient support of a fast wearing doctor blade for a rotogravure printing press. In this arrangement the doctor blade is positioned generally vertically to the periphery of the jacket of the cylinder to be inked. This type of an arrangement would not be usable in a short inking unit as part of a chambered doctor blade assembly. In these short inking units, the spaced doctor blades engage the surface of the screened ink roller at a negative angle. If particularly thin, flexible doctor blades are brought into contact with the screened ink roller at a negative contact angle with an excessive amount of force during throw-on of the doctor blades or are bent as a result of an excessive pre-load, they will wear excessively. This excessive wear causes the doctor blades to have to be replaced too frequently and may also raise the greater question of whether the doctor blades can perform their function of being so-called stripping-off blades.

It will thus be apparent that a need exists for a doctor blade bar assembly which overcomes the limitations of the prior art. The doctor blade bar for a short inking system of a web-fed rotary printing press in accordance with the present invention provides such a device and is a significant improvement over the prior art devices.

SUMMARY OF THE INVENTION

It is an object of the present invention to provide a doctor blade bar for a short inking system.

Another object of the present invention is to provide a doctor blade bar for a short inking system of a rotary printing press.

A further object of the present invention is to provide a doctor blade bar for a short inking unit of a web-fed rotary printing press in which particularly the working doctor blade is placed at a negative angle against the screen roller.

Yet another object of the present invention is to provide a doctor blade bar for a short inking unit which prevents warping of the working edge of the doctor blade.

Still a further object of the present invention is to provide a doctor blade bar for a short inking unit in which at least one doctor blade can be held out of contact with the screen roller.

Even yet another object of the present invention is to provide a doctor blade bar for a short inking unit in which the service life of the doctor blades can be increased.

As will be discussed in detail in the description of the preferred embodiment which is set forth subsequently, the doctor blade bar in accordance with the present invention utilizes at least one doctor blade base body member, as part of the doctor blade bar, with this base body member supporting a working doctor blade in a doctor blade holder. This blade holder is secured to a doctor blade guide that has a pressure spring which acts to move the doctor blade toward the surface of the screened roller. An eccentric disk is rotatably supported in the base body member and is engageable with an abutment surface on the doctor blade holder. The eccentric disk is rotatable by means of a handle to shift the doctor blade holder away from the screen roller.

The doctor blade bar of the present invention has several advantages over the prior art devices. Because of the resilient placement of the working doctor blade along a straight line which extends in the direction of the crosswise axis of the working doctor blade, bending of the doctor blade due to pre-stressing when placing it against the screen roller is prevented.

The doctor blade holder is secured to the doctor blade guide which is, in turn, resiliently urged toward the screen roller by springs. Thus, as the doctor blade wears, it is urged toward the screen roller. The service life of the doctor blades is thereby increased because of this continuous adjustment of the doctor blade by means of the spring force.

The eccentric disk and its actuating handle are supported by a journal that passes through an elongated hole in the doctor blade guide and blade holder. This is an uncomplicated assembly which can be easily and quickly actuated to move the doctor blade into or out of contact with the screen roller. It is also possible, in accordance with the present invention, to employ an ink-providing roller of a different type in place of a screen roller.

It will thus be seen that the doctor blade bar for a short inking system in accordance with the present invention overcomes the limitations of the prior art devices and is a substantial advance in the art.

BRIEF DESCRIPTION OF THE DRAWINGS

While the novel features of the doctor blade bar for a short inking system of a web fed rotary printing press in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
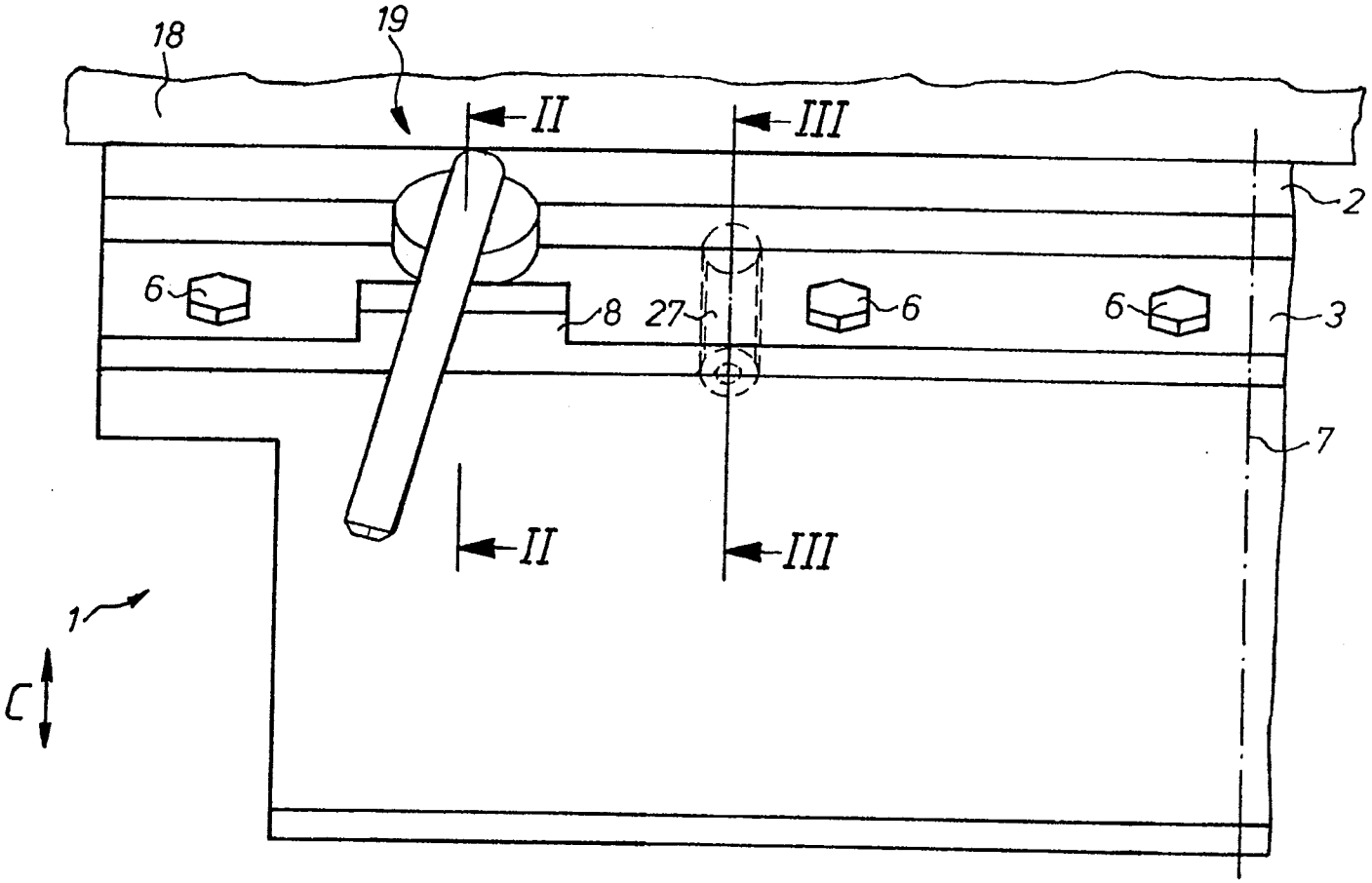
FIG. 1 is a partial front view of a screen roller utilizing the doctor blade bar in accordance with the present invention.

Referring initially to FIG. 1, there may be seen generally at 1 a partial front view of a doctor blade bar in accordance with the present invention. The doctor blade bar 1 supports a working doctor blade 2 which is engageable with the surface of a screen roller, generally at 18. The doctor blade bar 1 is symmetrical about a center line 7 which is shown in FIG. 1. Thus it will be understood that the portion of the doctor blade bar 1, doctor blade 2 and its associated holder and actuating assembly, as will be discussed shortly, is only one half of the complete doctor blade bar in accordance with the present invention.

Figure 2:
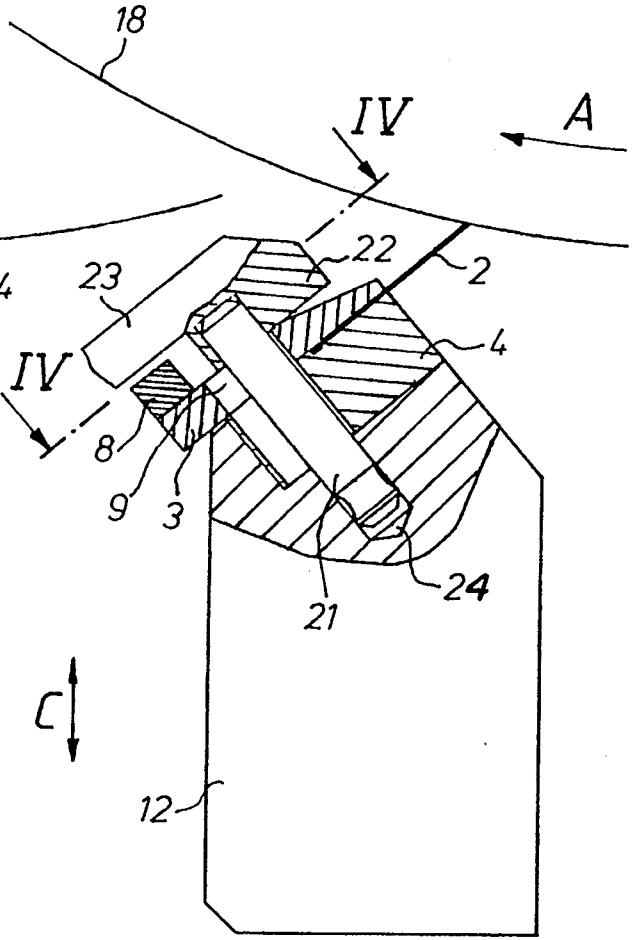
FIG. 2 is a side elevation view partly in cross-section, taken along line II—II of FIG. 1 and showing the doctor blade bar and working doctor blade.
Figure 3:
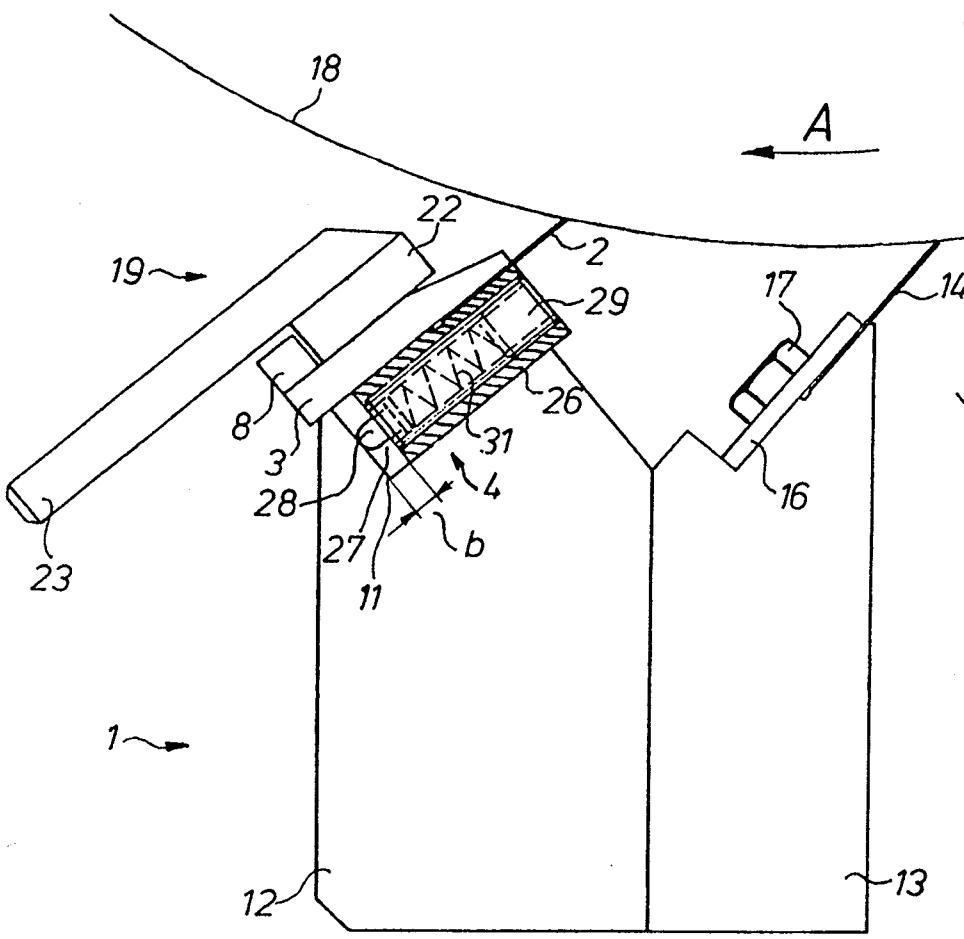
FIG. 3 is a side elevation view, partly in section, taken along line III—III of FIG. 1 and showing the doctor blade holder and doctor blade guide.

Turning now also to FIGS. 2 and 3 and taken in conjunction with FIG. 1, the working doctor blade 2 is placed between a doctor blade holder 3 and a doctor blade guide 4. The doctor blade holder 3 is secured to the doctor blade guide 4 by spaced screws or bolts 6 which are spaced along the length of the doctor blade holder 3. An upwardly extending abutment or flange 8 is formed at a rear edge portion of the doctor blade holder 3 remote from a forward edge of the blade holder which is adjacent the screen roller 18. This abutment 8 is securely fastened to, or formed as a part of the doctor blade holder 3.

Referring now to FIG. 3, the doctor blade bar 1 is formed by first and second cooperating doctor blade supporting base bodies 12 and 13. The first base body 12 supports the working doctor blade 2 while the second base body 13 supports a closing or sealing doctor blade 14 as will be discussed in detail shortly. The doctor blade guide 4 is located in a receptacle or recess 11 in the first base body. This placement allows the doctor blade guide 4 and the doctor blade holder 3 and the working or stripping off doctor blade 2 held between them to be moved toward or away from the screen roller without moving the doctor blade bar 1. The closing doctor blade 14 is carried on the second base body 13 in a doctor blade holder 16 by means of suitable screws 17. The doctor blades 2 and 14 are interchangeable and engage the surface of the screen roller 18 at a negative placement angle of approximately 40°. The screen roller 18 has a rotational direction as indicated by the arrow A.

Figure 4:
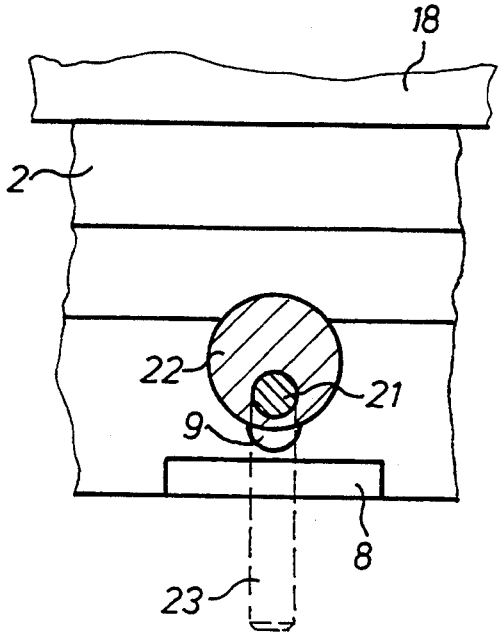
FIG. 4 is a top plan view, partly in section, taken along line IV—IV of FIG. 3 and showing the working doctor blade in engagement with the screen roller.
Figure 5:
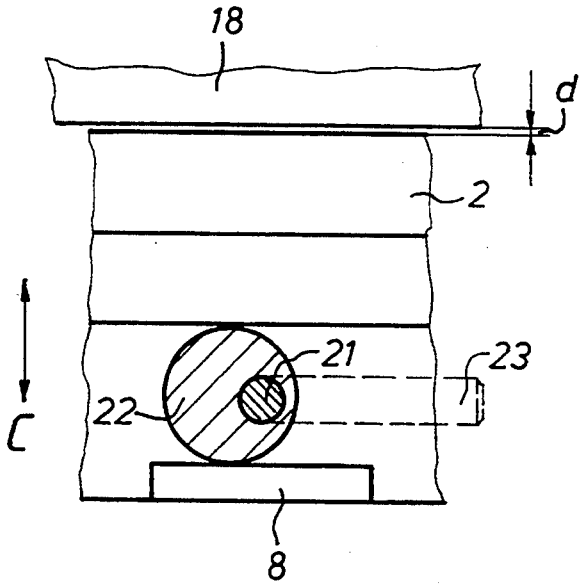
FIG. 5 is a view similar to FIG. 4 and showing the working doctor blade in a retracted position.

The working doctor blade 2 is supported by the blade holder 3 and the blade guide 4 in the receptacle 11 in the first base body 12 of the doctor blade bar 1 so that it can be moved toward or away from the screen roller 18 independently of movement of the entire doctor blade bar 1. A doctor blade actuating mechanism is shown generally at 19 in FIGS. 1 and 3. This actuating mechanism 19 includes a journal 21, as seen in FIGS. 2, 4 and 5. An eccentric disk 22 is secured to a first, upper end of the journal 21. This eccentric disk 22 is provided with a handle 23 that can be grasped to rotate the eccentric disk 22. As shown most clearly in FIG. 2, the second end of the journal 21 is rotatably received in a bore 24 in the first base body. 12. The journal passes through an elongated, generally oval aperture or hole 9 which, as shown in FIGS. 2 and 4, is formed in both the doctor blade holder 3 and the underlying doctor blade guide 4. It will be recalled that the doctor blade bar 1 is symmetrical about centerline 7 and that there will thus be provided two spaced doctor blade actuating mechanisms 19, one on either side of the centerline 7 of the doctor blade bar 1.

The doctor blade guide, generally at 4, is shown most clearly in FIG. 3. It includes a base strip 26 which extends along the receptacle 11 in the lengthwise direction of the doctor blade bar 1 and the axial direction of the screen roller 1. This strip 26 has two spaced bores 27, with each of the bores being positioned generally intermediate the centerline 7 and one of the actuating mechanisms 19, as seen in FIG. 1. Each of these two bores 27 has a pressure piece 28 at a rear portion of the bore 27, generally in the side of the strip 26 closer to the abutment 8, and an adjusting screw 29 in a forward end of the bore 27 generally adjacent the screen roller 18. A pressure spring 31 is held in each bore 27 between each pressure piece 28 and each adjusting screw 29. The force exerted by the pressure piece 27 against the rear wall of the receptacle 11 can be varied by changing the position of the adjusting screw 28 or by changing the pressure spring 31. This allows the distance "b" of the doctor blade guide 4 with respect to the rear wall of the receptacle 11, when the actuating mechanism 19 is disengaged, to be changed to compensate for wear of the doctor blade 2.

In operation of the doctor blade bar for a short inking system in accordance with the present invention, the doctor blade bar, generally at 1, is moved generally from a rest position to an operative or work position, generally in the upward direction indicated by the arrow C in FIG. 3 by suitable means, such as guides and hydraulic cylinders, not specifically shown. As the doctor blade bar 1 is placed against the screen roller 18, the doctor blade bar 1 is moved vertically upwardly by the not depicted guides and cylinders until the working edge of the closing doctor blade 14, which is carried by the second base body 13, is in contact with the surface of the screen roller 18. At this point, the working doctor blade 2 is held in its retracted or arrested position, which is shown in FIG. 5, by the actuating mechanism 19. In this retracted or arrested position, there is a distance "d" between the screen roller 18 and the working edge of the working doctor blade. It will be noted in FIG. 5, that the eccentric disk 22 has been rotated by handle 23 into a position in which it is in contact with the abutment or flange 8 on the doctor blade holder 3. Since the doctor blade holder 3 is secured to the doctor blade guide 4, both have been moved, by the engagement of the eccentric disk 22 with the abutment 8 into the retracted or arrested position shown in FIGS. 3 and 5. The doctor blade guide 4 and the doctor blade holder 3 with their associated doctor blade 2 have been moved toward the rear wall of the receptacle 11 against the force of the pressure spring 31. This movement with respect to the journal 21 is possible due to the elongated oval aperture 9 through which the journal 21 passes.

Once the doctor blade bar 1 has been positioned as shown in FIG. 3, the eccentric disks 22 can be rotated by actuation of handles 23 to the position shown in FIG. 4. In this position, the eccentric disks 22 are no longer in contact with the abutments 8. The pressure springs 31 in the bores 27 in the strip 26 on both sides of the centerline 7 are now able to move the doctor blade guide 4, the doctor blade holder 3 and the working doctor blade 2 toward the screen roller 18 until the working end of the doctor blade 2 is in contact with the surface of the screen roller 18. The working doctor blade 2 is thereby resiliently urged into contact with the screen roller 18. Retraction of the working doctor blade 2 away from the screen roller can be easily accomplished by movement of the handles 23 of the actuating mechanism 19 to again bring the eccentric disks 22 into contact with the abutments 8.

While a preferred embodiment of a doctor blade bar for a short inking system of a web-fed rotary printing press in accordance with the present invention has been set forth fully and completely hereinabove, it will be understood that a number of changes in, for example, the size of the screen roller, the number of doctor blade bars placed adjacent the screen roller, the apparatus used to shift the doctor blade bar into position adjacent the screen roller and the like may be made without departing from the true spirit and scope of the present invention which is accordingly to be limited only by the following claims.

We claim:

1. A doctor blade bar assembly for a short inking system of a web-fed rotary printing press, said doctor blade bar assembly comprising:

a doctor blade bar having at least a first doctor blade supporting base body;

a doctor blade holder and a doctor blade guide slidably supported on said doctor blade bar for movement with respect to said at least first doctor blade supporting base body and supporting a doctor blade;

means to resiliently urge said doctor blade guide and said doctor blade for sliding movement on said doctor blade bar independent of movement of said first doctor blade supporting base body toward a surface of an ink-dispensing roller; and actuating means to retract said doctor blade guide and said doctor blade holder away from a surface of an ink-dispensing roller to move said doctor blade away from an ink-dispensing roller and to hold said doctor blade guide and said doctor blade holder and said doctor blade in a retracted position while keeping said doctor blade bar stationary.

2. The doctor blade bar assembly of claim 1 wherein said doctor blade guide has a plurality of spaced through bores and pressure pieces located in said through bores, and further wherein said means to resiliently urge said doctor blade guide and said doctor blade toward a surface of an ink dispensing roller includes springs positioned in said through bores, said springs acting on said pressure pieces which are carried in said through bores in said doctor blade guide and which engage said base body.

3. The doctor blade bar assembly of claim 1 wherein said actuating means includes eccentric disks and journals in said base body, said eccentric disks being rotatably supported by said journals and being engageable with said doctor blade holder.

4. The doctor blade assembly of claim 3 wherein each said eccentric disk has a handle.

5. The doctor blade bar assembly of claim 3 wherein said journals are rotatably seated in blind bores in said base body and further wherein said doctor blade holder includes abutments, said eccentric disks being engageable with said abutments on said doctor blade holder.

6. The doctor blade bar assembly of claim 3 further including elongated apertures in said doctor blade holder and said doctor blade guide wherein said journals pass through said elongated apertures in said doctor blade holder and said doctor blade guide.

7. The doctor blade bar assembly of claim 1 wherein said doctor blade is disposed in said doctor blade bar at a negative placement angle with respect to an ink-dispensing roller.

8. The doctor blade bar assembly of claim 2 further including a pressure piece in each of said through bores adjacent a rear surface of said doctor blade guide and an adjustment screw in each of said through bores adjacent a forward surface of said doctor blade guide, said adjustment screw being usable to adjust a spring force applied by said spring to said pressure piece in each of said through bores.

* * * * *